US007040216B2

(12) United States Patent
Sekiguchi et al.

(10) Patent No.: US 7,040,216 B2
(45) Date of Patent: May 9, 2006

(54) HYDRAULIC MOTOR

(75) Inventors: Hideki Sekiguchi, Tokyo (JP); Manabu Yoshida, Tokyo (JP)

(73) Assignee: Kayaba Industry Co., Ltd., Tokyo (JP)

( * ) Notice: Subject to any disclaimer, the term of this patent is extended or adjusted under 35 U.S.C. 154(b) by 20 days.

(21) Appl. No.: 10/508,657

(22) PCT Filed: Jul. 2, 2003

(86) PCT No.: PCT/JP03/08408

§ 371 (c)(1),
(2), (4) Date: Sep. 22, 2004

(87) PCT Pub. No.: WO2004/011797

PCT Pub. Date: Feb. 5, 2004

(65) Prior Publication Data

US 2005/0252204 A1 Nov. 17, 2005

(30) Foreign Application Priority Data

Jul. 29, 2002 (JP) ..... 2002-219159

(51) Int. Cl.
*F03C 1/253* (2006.01)

(52) U.S. Cl. ..... 92/12.2; 92/18

(58) Field of Classification Search ..... 92/12.2, 92/18, 21 R, 71; 91/499; 74/60
See application file for complete search history.

(56) References Cited

U.S. PATENT DOCUMENTS 3,439,766 A * 4/1969 Frost et al. ..... 91/499
3,808,949 A * 5/1974 Muncke et al. ..... 91/473
4,565,117 A * 1/1986 Forster ..... 92/71
5,497,622 A * 3/1996 Nam ..... 60/435
6,119,580 A * 9/2000 Sato et al. ..... 92/12.2
6,336,323 B1 * 1/2002 Tanabe et al. ..... 92/21 R
6,663,354 B1 * 12/2003 Forster ..... 92/12.2

FOREIGN PATENT DOCUMENTS

EP 1067305 7/2000
JP 08-061212 3/1996

* cited by examiner

*Primary Examiner*—Thomas E. Lazo

(74) *Attorney, Agent, or Firm*—Rabin & Berdo, P.C.

(57) ABSTRACT

A hydraulic motor is equipped with an output shaft (2), a cylinder (4) arranged around the output shaft and receiving a plurality of pistons (6) expanding with the fluid pressure, a diagonal plate (7) that contacts the plurality of the expanding pistons (6), thereby to exert rotational force to the cylinder (4), a brake disc (21) disposed outside the cylinder (4) to rotate together therewith, a motor casing (11, 12) receiving the cylinder (4) and the brake disc (21), a brake driving device (25) that presses an outer periphery of the brake disc (21) on an inner peripheral surface of the motor casing (11, 12) to brake the brake disc. A first chamber (14) and a second chamber (15) are defined in the motor casing (11, 12) by the brake disc (21) and a communicating passage (30) formed bypassing the brake disc (21) communicates the first chamber 814) with the second chamber (15). Since the pressure difference between the first chamber (14) and the second chamber (15) is prevented due to the communicating passage (30), the friction resistance does not occur at the brake disc (21) when the braking is released.

4 Claims, 4 Drawing Sheets

HYDRAULIC MOTOR

TECHNICAL FIELD

The present invention relates to a hydraulic motor for use in a running system for construction equipment or the like.

BACKGROUND ART

A hydraulic motor is provided with a diagonal plate received in a motor casing, a cylinder block with an output shaft penetrating through the diagonal plate and a plurality of pistons that reciprocate inside the cylinder block. A tip of the plurality of the pistons contacts the diagonal plate. The plurality of the pistons expand caused by hydraulic pressure applied thereon. The plurality of the pistons expand in turn, so that the cylinder block rotates around the output shaft.

A hydraulic motor described in a Japanese Unexamined Patent Publication No. 8-61212 published in 1996 by Japan Patent Office is provided with a brake disc and a brake driving device. The brake disc rotates together with a cylinder block. A rotation of an output shaft ceases by braking a rotation of the brake disc with friction resistance caused by pressing the brake disc on a motor casing with the brake driving device.

In the above-mentioned earlier hydraulic motor, however, a space in the motor casing is divided into two chambers by the brake disc. Accordingly, when the hydraulic motor operates, a pressure difference between the two chambers is likely to arise, which possibly presses the brake disc on the motor casing even if the braking by the brake driving device is released.

Therefore, a braking force exerts on the output shaft during operating the hydraulic motor and an efficiency of the hydraulic motor threatens to deteriorate.

Accordingly, in the related art an attempt to cancel the pressure difference between the two chambers due to disposing a communicating bore at the brake disc is made. However, flow of an operating fluid is interrupted by rotation of the brake disc and as a result, the pressure difference between the two chambers still occurs. The brake disc is pressed on the motor casing by reason of the pressure difference occurred and as a result, a friction resistance occurs at the brake disc. Namely, when the hydraulic motor is operating, the friction resistance occurs at the brake disc.

DISCLOSURE OF THE INVENTION

Accordingly, an object of the present invention is to provide a hydraulic motor where a friction resistance does not occur at a brake disc when braking is released.

In order to achieve the above object, the present invention provides a hydraulic motor which comprises an output shaft, a cylinder arranged around the output shaft and receiving a plurality of pistons expanded by the fluid pressure, a diagonal plate that contacts the plurality of the expanding pistons, thereby to exert rotational force to the cylinder, a brake disc disposed outside the cylinder to rotate together therewith, a motor casing receiving the cylinder and brake disc, a brake driving device that presses an outer periphery of the brake disc on an inner peripheral surface of the motor casing to brake the brake disc, a first chamber and a second chamber defined in the motor casing by the brake disc, and a communicating passage formed bypassing the brake disc to communicate the first chamber with the second chamber.

As described above, since the communicating passage that communicates the first chamber with the second chamber is disposed bypassing the brake disc, a pressure difference between the first chamber and the second chamber does not occur. Therefore, when the braking is released, occurrence of a friction resistance at the brake disc is avoided.

It is preferable that the communicating passage is formed in the motor casing for the hydraulic motor. As a result thereof, the operating fluid smoothly flows between the first chamber and the second chamber without interruption due to rotation of the brake disc, and the pressure difference therebetween does not occur.

Also the communicating passage may be formed in the output shaft of the hydraulic motor. As a result thereof, a position of the communicating passage does not change regardless of the rotation of the output shaft and therefore, the operating fluid smoothly flows between the first chamber and the second chamber.

BRIEF EXPLANATION OF THE DRAWINGS

FIG. 1 is a cross sectional view of a hydraulic motor of a first embodiment the present invention is applied to.

FIG. 4 is a cross sectional view showing a hydraulic motor of a second embodiment the present invention is applied to.

BEST MODE FOR CARRYING OUT THE INVENTION

Embodiments according to the present invention will be explained with reference to accompanying drawings.

Figure 1:
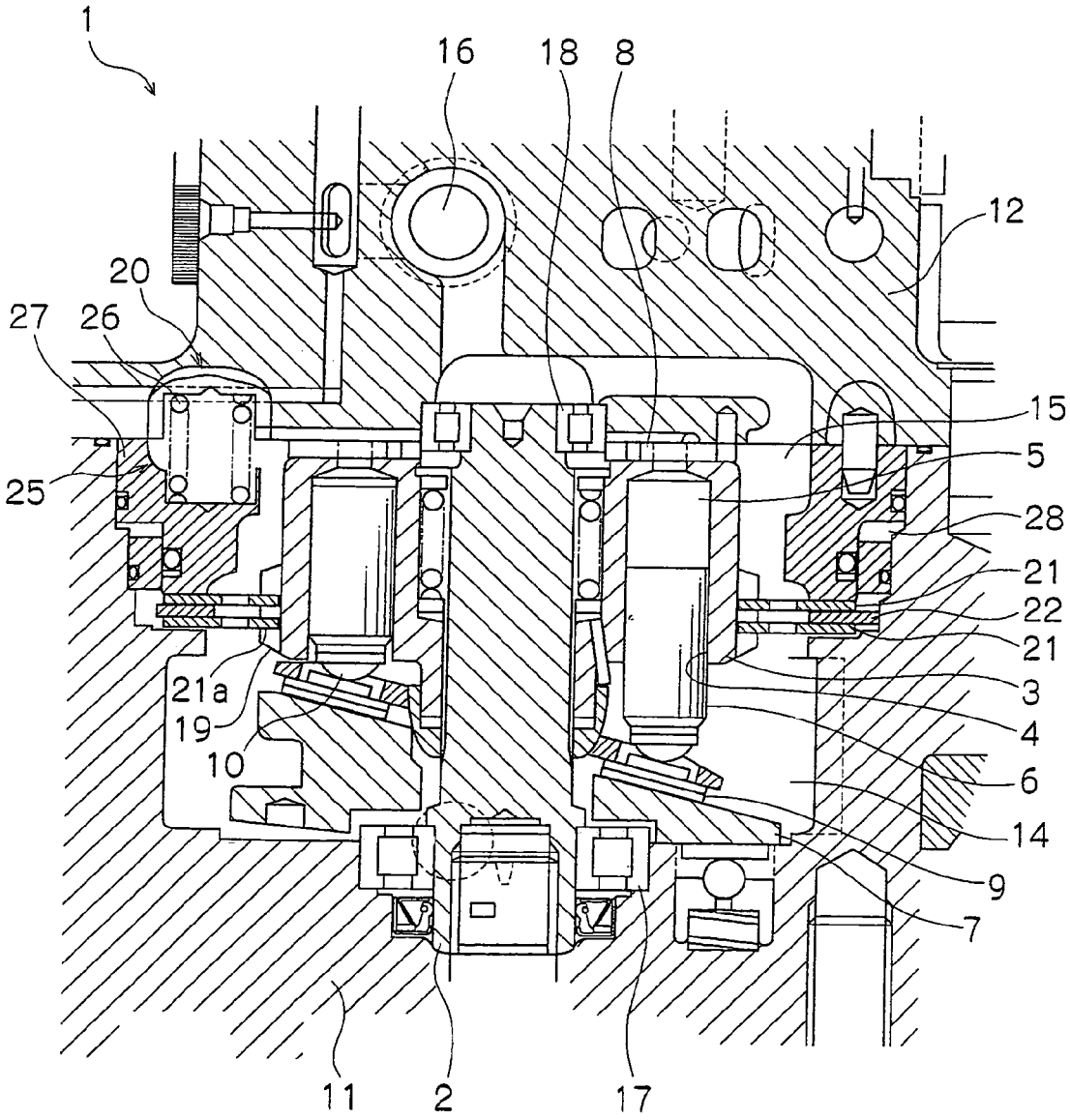

FIG. 1 shows a diagonal plate-hydraulic motor of a first embodiment the present invention is applied to.

A hydraulic motor 1 is provided with an output shaft 2 and a cylinder block 3 where the output shaft 2 is supported through bearings 17, 18 by the motor casings 11, 12. The cylinder block 3 rotates together with the output shaft 2 and includes a plurality of cylinders 4. The respective cylinders 4 are disposed in parallel with the output shaft 2, as well as on substantially the same circumference centering around the output shaft 2. A piston 6 is inserted in each of the cylinders 4 to define a capacity chamber 5 between the cylinder 4 and the piston 6.

The piston 6 has a spherical seat 10 in a tip thereof. The hydraulic motor 1 is provided with a diagonal plate 7 in a tip side of the piston 6. A shoe 9 is disposed on a diagonal surface of the diagonal plate 7, receives the spherical seat 10 of the piston 6, and slides on the diagonal surface thereof. The spherical seat 10 of the piston 6 contacts the shoe 9. When the cylinder block 3 rotates, the piston 6 rotates centering around the output shaft 2. Accompanying the rotation of the piston 6, the shoe 9 rotates on the diagonal surface of the diagonal plate 7 around the output shaft 2. The piston 6 reciprocates by a stroke amount corresponding to an inclined angle of the diagonal plate 7 in accordance with the rotation of the shoe 9.

The hydraulic motor 1 is provided with a valve plate 8 that slides on an end surface of the cylinder block 3. The valve plate 8 includes an inlet port that is communicated with a hydraulic source (not shown) and an outlet port that is communicated with a tank (not shown). The piston 6 expands from the cylinder 4 due to a hydraulic pressure introduced to the capacity chamber 5 from the hydraulic source through the inlet port. And the piston 6 presses through the shoe 9 the diagonal plate 7. A directional force working on the diagonal surface of the diagonal plate 7 exerts in the rotational direction of the cylinder block 3. Then the shoe 9 rotates on the diagonal surface of the diagonal plate 7 around the output shaft 2 and the cylinder block 3 rotates around the output shaft 2. The rotation of the cylinder block 3 is transmitted to the outside device (not shown) through the output shaft 2.

The hydraulic motor 1 includes a brake mechanism 20 that carries out braking with a friction force. The brake mechanism 20 is provided with two brake discs 21, one friction plate 22, and a brake driving device 25. The brake driving device 25 presses the brake discs 21 and the friction plate 22 on the motor casing 11.

The brake disc 21 is a circular member having a friction surface 21*d* at an outer edge (see FIG. 3) and has a plurality of teeth 21*a* arranged in an inner periphery. The cylinder block 3 has a spline 19 in an outer periphery extending in the axial direction thereof. The teeth 21*a* engage the spline 19. The brake discs 21 rotate together with the cylinder block 3. The brake discs 21 slide and move in an axial direction.

The brake driving device 25 is provided with a brake piston 27, a plurality of brake springs 26, and a pressure chamber 28.

The brake piston 27 is circular. The brake piston 27 moves in the axial direction with respect to the motor casing 11. The brake springs 26 press the brake piston 27 on the brake disc 21. As pressure in the pressure chamber 28 increases, the pressure therein drives the brake piston 27 against the brake springs 26.

The pressure chamber 28 is selectively communicated with the tank or the hydraulic source through a hydraulic circuit (not shown). As the pressure chamber 28 becomes communicated with the tank, the pressure in the pressure chamber 28 decreases. Then the brake spring 26 presses the brake disc 21 on the motor casing 11, to brake the rotation of the cylinder block 3 by reason of friction resistance. On the other hand, when the pressure chamber 28 becomes communicated with the hydraulic source, the pressure in the pressure chamber 28 increases. Then the brake piston 27 moves away from the brake disc 21 against the brake spring 26. At this moment the friction resistance between the brake disc 21 and the brake piston 27 disappears and the braking of the rotation of the cylinder block 3 is released.

The hydraulic motor 1 is provided with the motor casing 11 and a motor casing 12 where the cylinder block 3 and the brake mechanism 20 are housed. The motor casing 12 includes a drain passage 16 that is communicated with the tank (not shown).

An inside of the motor casings 11, 12 has a first chamber 14 and a second chamber 15 divided by the brake disc 21. Accordingly, when the hydraulic motor 1 is activated, it is possible that a pressure difference occurs between the first chamber 14 and the second chamber 15 therein. When the pressure difference between the first chamber 14 and the second chamber 15 becomes large, the brake disc 21 is pressed on the brake piston 27 or the motor casing 11, thereby to increase the friction resistance.

Figure 2:
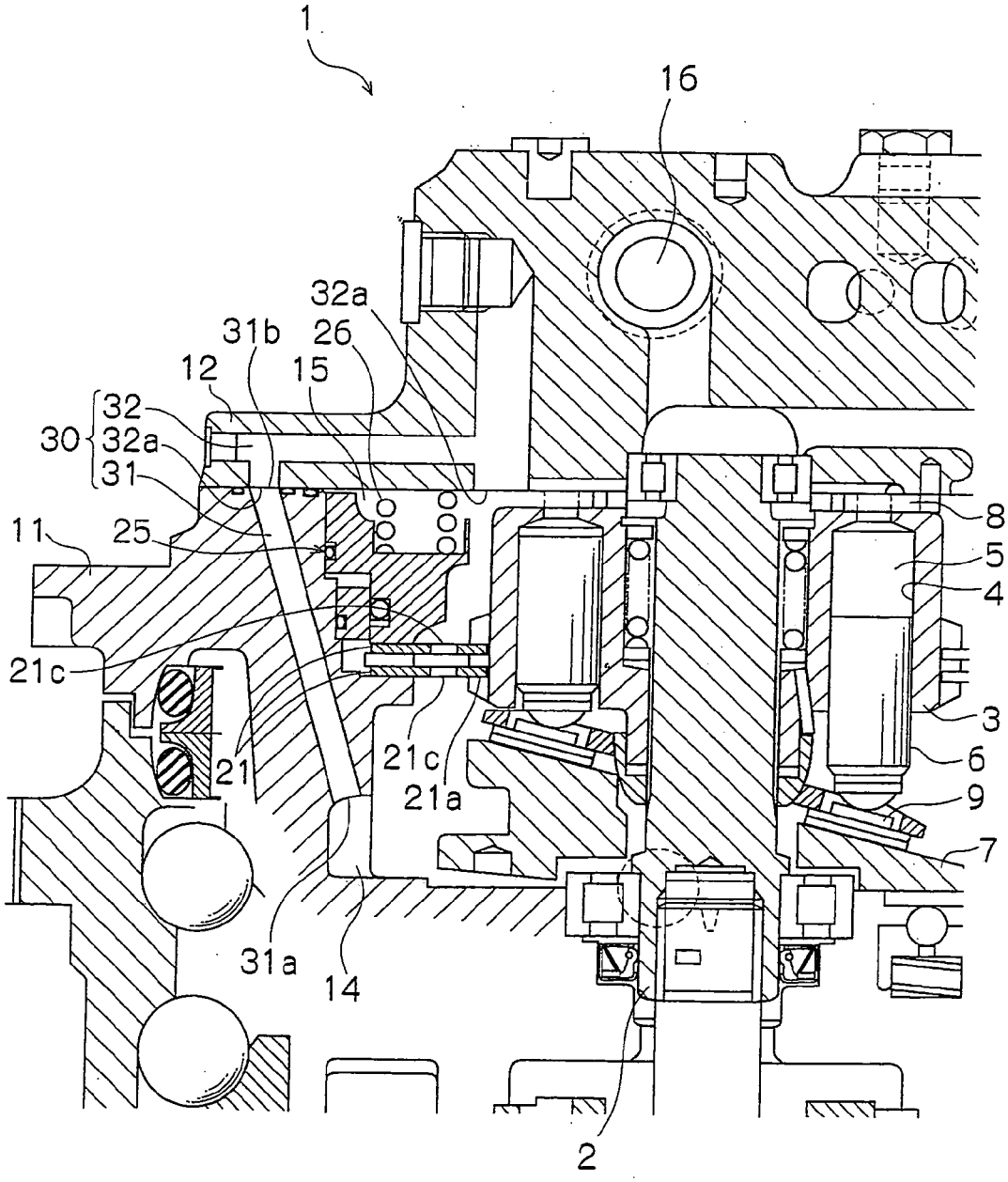
FIG. 2 is a partial enlarged view of the first embodiment showing a cross sectional view thereof different from FIG. 1.

As shown in FIG. 2, the hydraulic motor 1 includes a communicating passage 30 that bypasses the brake disc 21 to communicate the first chamber 14 with the second chamber 15. The communicating passage 30 is provided with a through bore 31 and a through bore 32. The through bore 31 is formed in the motor casing 11. One end 31*a* of the through bore 31 is opened to the first chamber 14. The other end 31*b* of the through bore 31 is opened to the surface thereof contacting the motor casing 12. The through bore 32 is formed in the motor casing 12. One end 32*a* of the through bore 32 is opened to the second chamber 15. The other end 32*b* of the through bore 32 is opened to the surface thereof contacting the motor casing 11 and communicated with the through bore 31. The communicating passage 30 communicates the first chamber 14 with the second chamber 15, so that the pressure difference does not occur between the first chamber 14 and the second chamber 15.

Figure 3:
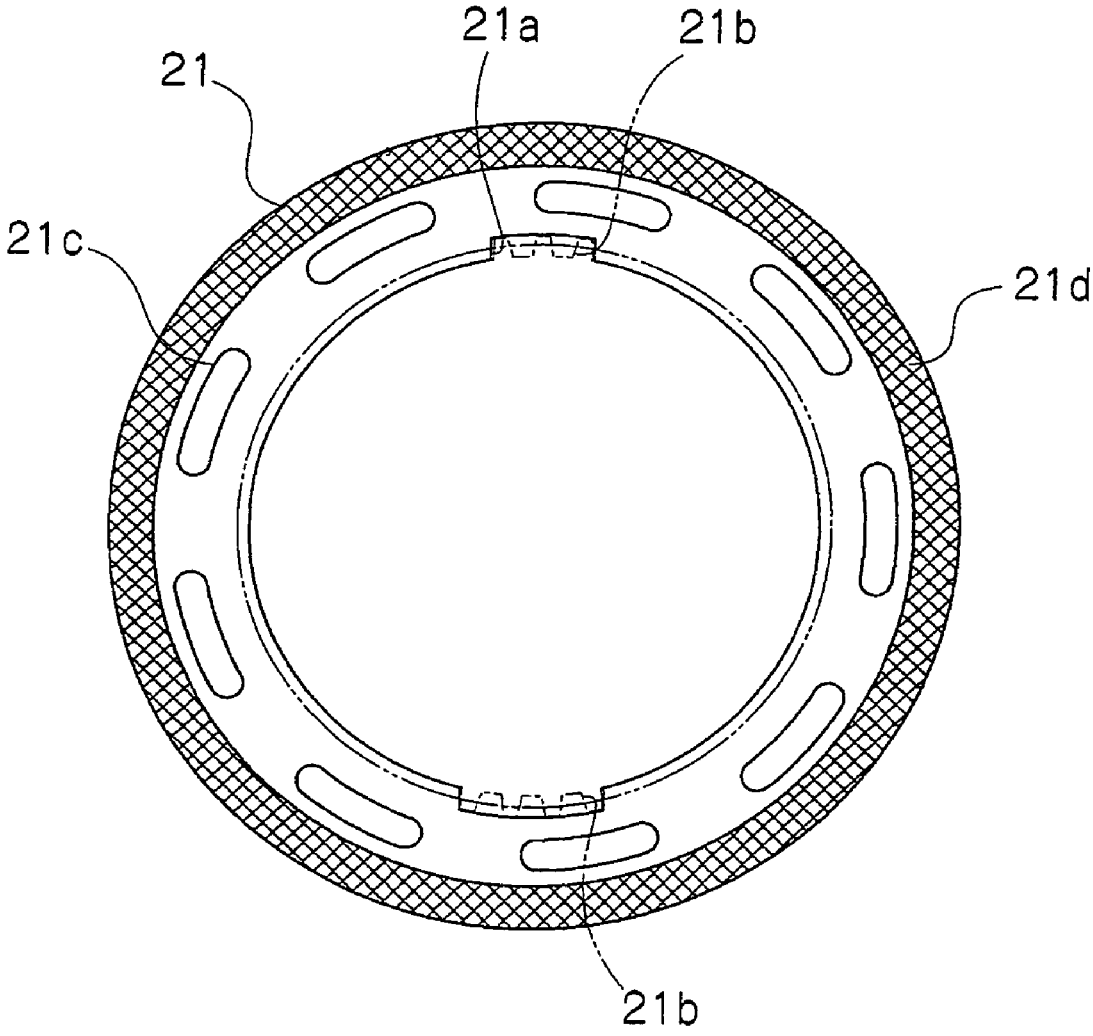
FIG. 3 is a plan view of a brake disc in a hydraulic motor.

As shown in FIG. 3, the brake disc 21 includes teeth 21*a* disposed in an inner peripheral surface thereof. The teeth 21*a* engage the spline 19 in the outer peripheral surface of the cylinder block 3. Two teeth notches 21*b* are formed where the teeth 21*a* are not formed on partial portions of the inner peripheral surface of the brake disc 21. The brake disc 21 includes a plurality of communicating bores 21*c* formed at equal intervals in the circumferential direction thereof. The teeth notches 21*b* and the respective communicating bores 21*c* are formed so that the pressure difference between the first chamber 14 and the second chamber 15 is not produced.

The operation of the hydraulic motor 1 will be explained as follows.

In the event of ceasing the hydraulic motor 1, the pressure chamber 28 is communicated with the tank. Then the pressure in the pressure chamber 28 is lowered and the brake spring 26 presses the brake disc 21 on the motor casing 11, causing the friction resistance to occur at the brake disc 21 and thereby braking the rotation of the cylinder block 3.

When the hydraulic motor 1 is activated, the pressure chamber 28 is communicated with the hydraulic source. Then the pressure in the pressure chamber 28 increases and the brake piston 27 moves away from the brake disc 21 against the brake spring 26 and the cylinder block 3 can rotate freely. Next, a hydraulic pressure is introduced to the cylinder 4 and the piston 6 reciprocates by reason of the hydraulic pressure, thereby to rotate and drive the cylinder block 3 through the diagonal plate 7 and the shoe 9.

Since the first chamber 14 and the second chamber 15 defined by the brake disc 21 are communicated with each other by the communicating passage 30 formed in the motor casings 11, 12, as well as the teeth notches 21*b* and the communicating bores 21*c* formed in the brake disc 21, the pressure difference does not occur between the first chamber 14 and the second chamber 15.

However, since the teeth 21*b* and the communicating bores 21*c* formed in the respective brake discs 21 rotate together with the cylinder block 3, flowing of the operating fluid between the first chamber 14 and the second chamber 15 is possibly interrupted.

According to the first embodiment, the communicating passage 30 is formed in the motor casings 11, 12. Therefore, the operating fluid smoothly flows between the first chamber 14 and the second chamber 15 without any influence of the rotation of the cylinder block 3 and the brake disc 21. As a result, since the pressure difference is not produced between the first chamber 14 and the second chamber 15, when the braking of the brake driving device 25 is released, the friction resistance does not occur in the brake disc 21. The disc 21 can be manufactured lighter by reason of forming the communicating bores 21*c* in the brake disc 21.

Figure 4:
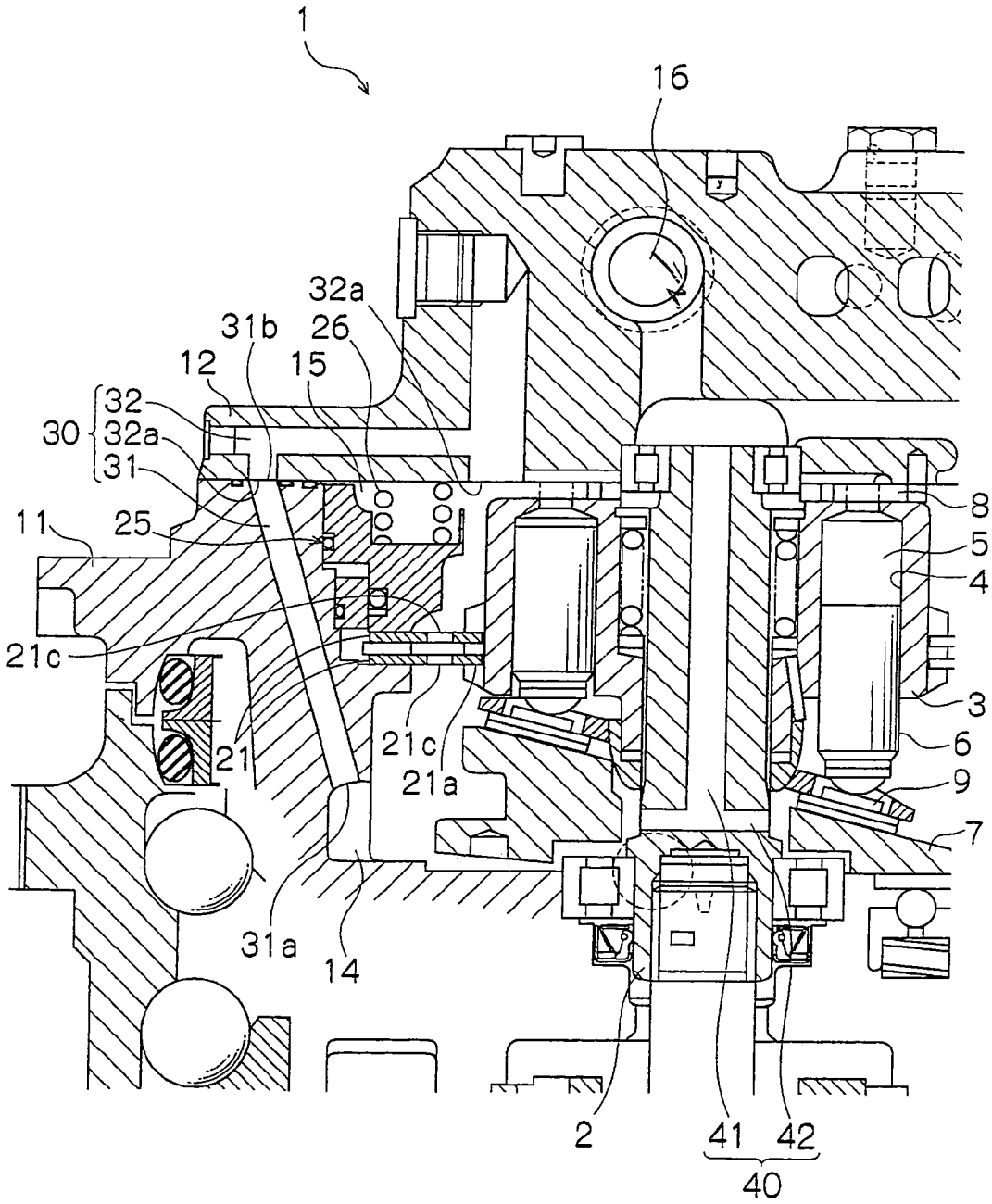

A second embodiment as shown in FIG. 4 will be explained as follows. The same reference numbers are attached to components thereof identical to those of the first embodiment.

A communicating passage 40 is formed in the output shaft 2 in order to communicate the first chamber 14 with the second chamber 15 and prevents the pressure difference from being produced between the first chamber 14 and the second chamber 15. A cross section of the communicating passage 40 is a shape of T-letter. The communicating passage 40 is provided with a through bore 41 that is formed extending co-axially with the output shaft 2 and a through bore 42 that is formed extending in the radial direction thereof.

Since the through bore 41 of the communicating passage 40 is formed co-axially with the output shaft 2, a position of the through bore 41 does not change regardless of rotation of the output shaft 2. Even when the output shaft 2 rotates, the operating fluid smoothly flows between the first chamber 14 and the second chamber 15 and accordingly, the pressure difference is not produced therebetween. Therefore, when the braking is released, the friction resistance does not occur at the brake disc 21. As a result, when the hydraulic motor 1 is activated, the friction resistance does not occur at the brake disc 21.

And as another embodiment, a passage that communicates the second chamber 15 with the tank may be formed independently of a passage that communicates the first chamber 14 with the tank. Thus the pressure difference between the first chamber 14 and the second chamber 15 can be restriced.

The preferred embodiments described herein are illustrative and not restrictive, and the present invention may be practiced and embodied in other ways without departing from the spirit or essential character thereof. It is apparent that variations which come within the meaning of the claims are intended to be embraced herein.

INDUSTRIAL APPLICABILITY

The present invention is useful to reduce a friction disc in a brake disc when braking in a hydraulic motor is released.

What is claimed:

1. A hydraulic motor comprising:

an output shaft (2);

a cylinder (4) arranged around the output shaft (2) and receiving a plurality of pistons (6) expanding by reason of hydraulic pressure;

a diagonal plate (7) that contacts the plurality of the expanding pistons (6), thereby to exert rotational force to the cylinder (4);

a brake disc (21) disposed outside the cylinder (4) and rotating therewith;

a motor casing (11, 12) receiving the cylinder (4) and the brake disc (21);

a brake driving device (25) that presses an outer periphery of the brake disc (21) on an inner peripheral surface of the motor casing (11, 12) to brake the brake disc (21);

a first chamber (14) and a second chamber (15) in the motor casing (11, 12) defined by the brake disc (21); and a communicating passage (30 or 40) formed bypassing the brake disc (21) to communicate the first chamber (14) with the second chamber (15).

2. A hydraulic motor as defined in claim 1, wherein the communicating passage (30) is formed in the motor casing (11, 12).

3. A hydraulic motor as defined in claim 1, wherein the communicating passage (40) is formed in the output shaft (2).

4. A hydraulic motor as defined in claim 1, wherein the communicating passage (30, 40) is formed in the motor casing (11, 12), as well as the output shaft (2).

* * * * *